United States Patent [19]

Little

[11] Patent Number: 4,984,906

[45] Date of Patent: Jan. 15, 1991

[54] MULTI-PURPOSE UTILITY TOTE

[76] Inventor: Vicki A. Little, P.O. Box 781, Santa Teresa, N. Mex. 88008

[21] Appl. No.: 500,931

[22] Filed: Mar. 29, 1990

[51] Int. Cl.[5] ..... B65D 30/00

[52] U.S. Cl. ..... 383/4; 383/6; 383/40; 383/97; 383/110; 190/2; 190/107; 5/420

[58] Field of Search ..... 383/4, 6, 40, 97, 110, 383/119; 190/2, 107; 5/417, 420

[56] References Cited

U.S. PATENT DOCUMENTS 3,777,862 12/1973 Zipper ..... 190/107
3,994,372 11/1976 Geller et al. ..... 190/107
4,509,645 4/1985 Hotta ..... 383/110 X

FOREIGN PATENT DOCUMENTS 2097244 11/1982 United Kingdom ..... 383/4

*Primary Examiner*—George E. Lowrance
*Assistant Examiner*—Jes F. Pascua
*Attorney, Agent, or Firm*—Hill, Van Santen, Steadman & Simpson

[57] ABSTRACT

A multi-purpose utility tote is provided which can be used for storage when it is fully closed and can provide a flat, cushioned surface when fully opened. The tote is comprised of a flat, T-shaped unit having a zipper chain disposed about the perimeter thereof. A slide fastener is located on the zipper chain with its initial starting position at an internal corner of the flat, T-shaped unit. The slide fastener is operable to transform the flat, T-shaped unit into a parallelipiped-shaped container.

21 Claims, 4 Drawing Sheets

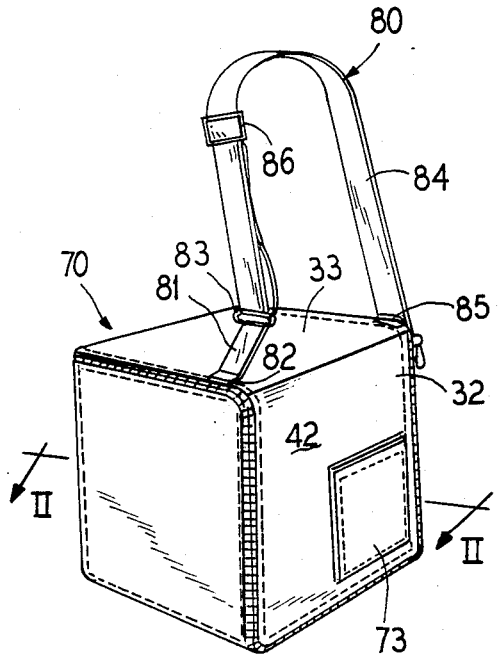
FIG. 1
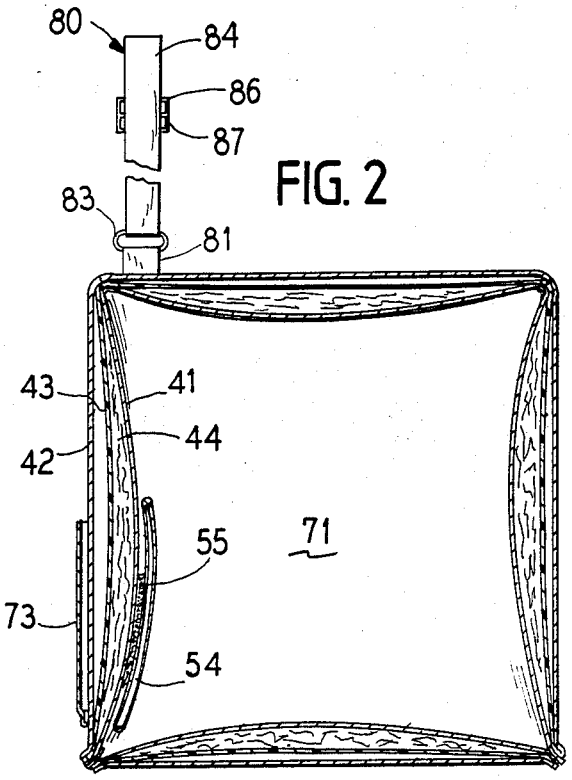
FIG. 2
FIG. 3
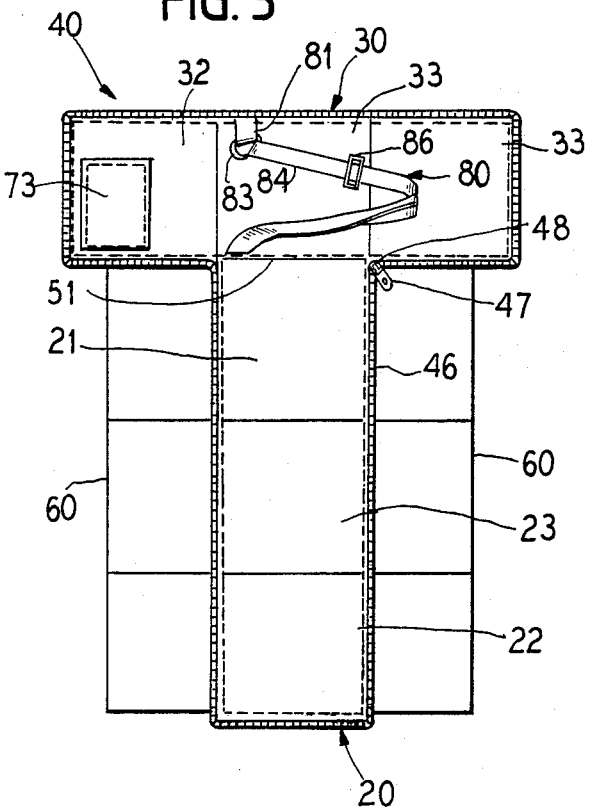
FIG. 4
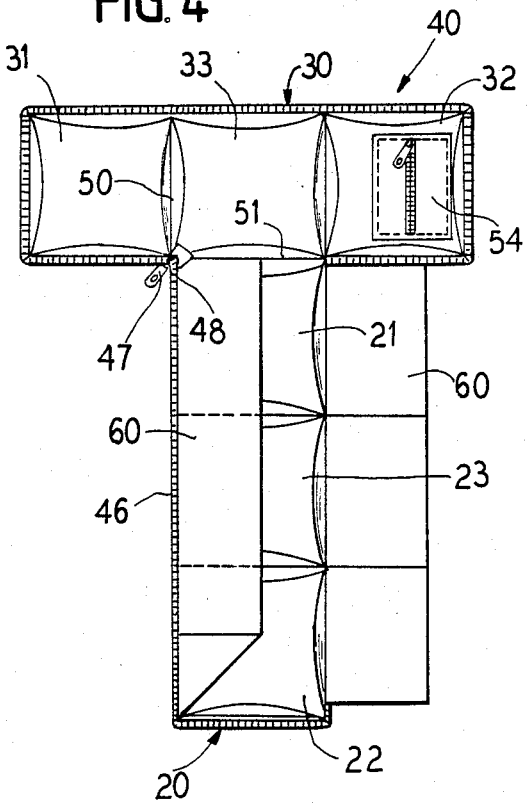

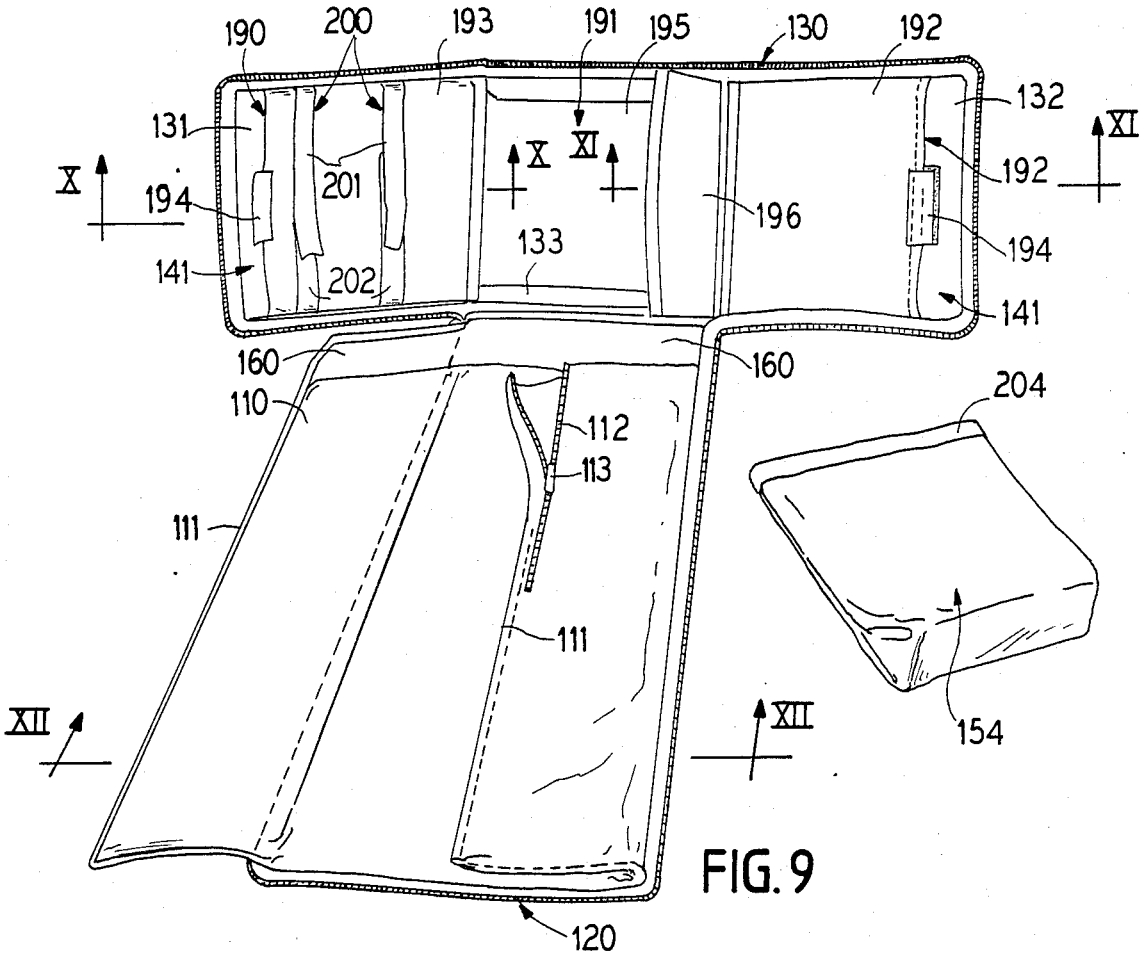
FIG. 9
FIG. 10
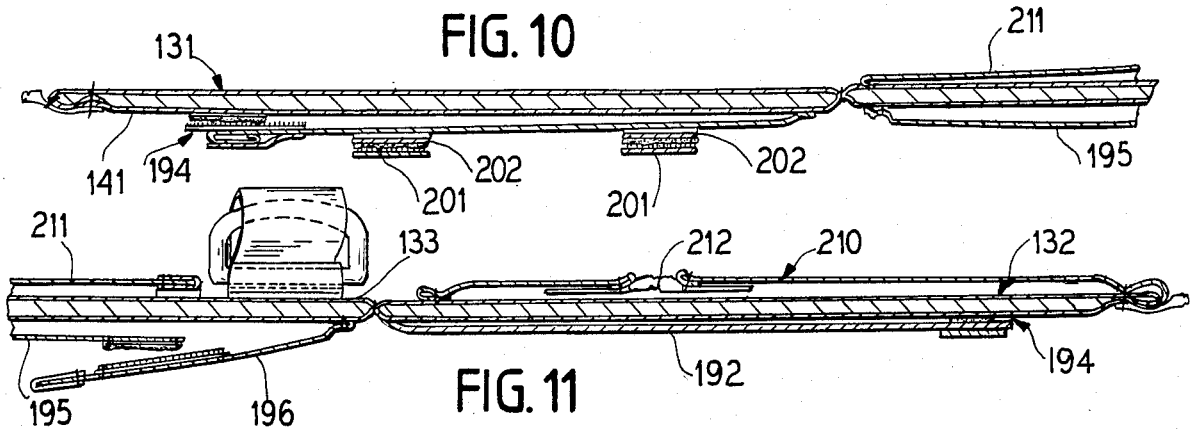
FIG. 11
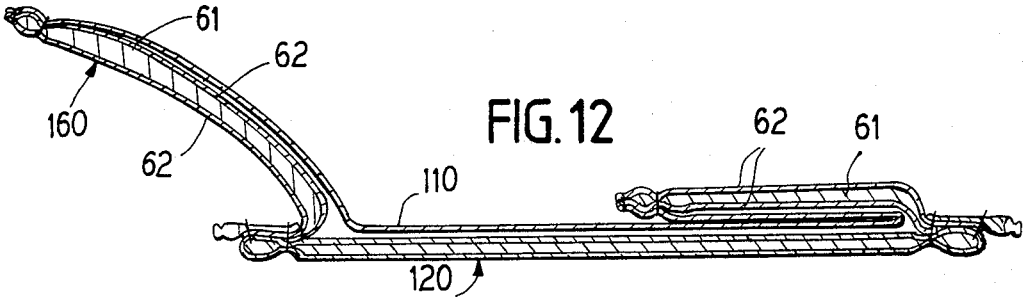
FIG. 12

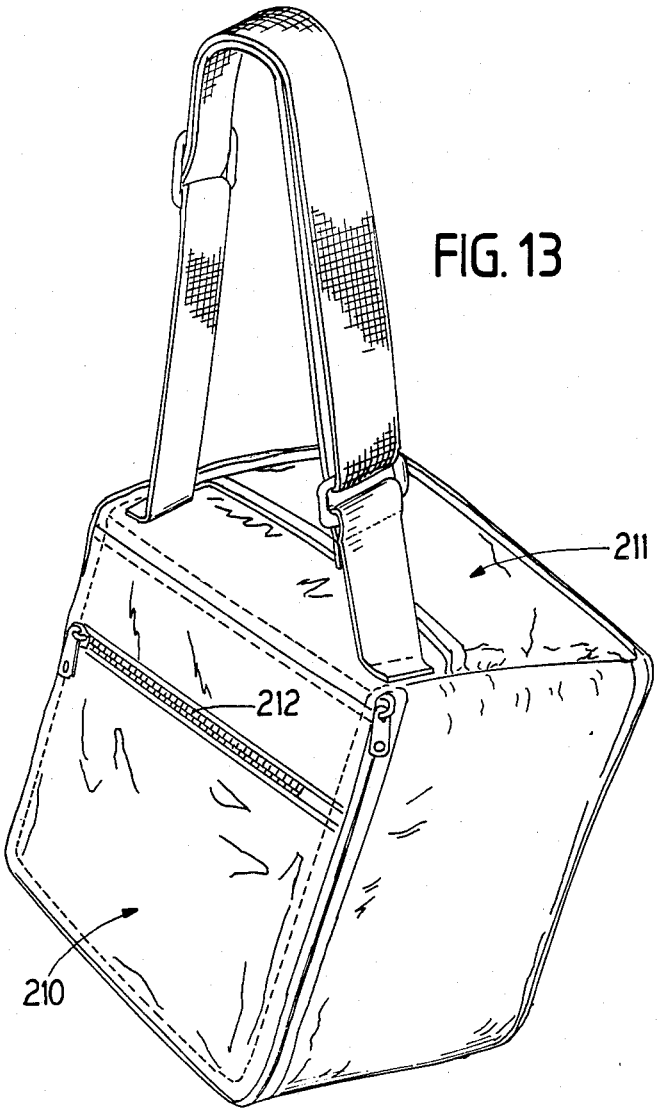
FIG. 13
FIG. 14
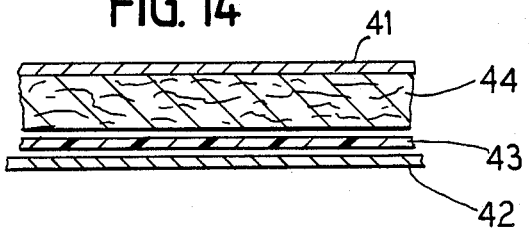

MULTI-PURPOSE UTILITY TOTE

BACKGROUND OF THE INVENTION

1. Field of the Invention

The present invention relates to a multi-purpose container. More specifically, the invention relates to a combination multi-panel and continuous zipper construction whereby the unit can be quickly and conveniently converted from a cubic shaped tote bag to a substantially flat unit suitable for a variety of purposes. It can be used for storage when it is fully closed and can provide a flat-cushioned surface when fully opened.

2. Description of the Prior Related Art

There are a variety of activities wherein there are space constraints which limit the ability of an individual to conveniently transport the items necessary to engage in the activity to the site where such activities are to take place. For example, during camping, picnicking, and other related activities, it is desirable to have a cushioned surface on which an individual may sit that will protect the individual from the rough and uneven ground surface and which will assist in thermally insulating the user. Typically, a blanket, or similar article, is used for such functions. However, the blanket is necessarily a further separate article which must be transported with the other paraphernalia associated with such activities, thereby presenting added space and transportation burdens associated therewith.

As another example, the mother of an infant child must often carry with her the various paraphernalia necessary to care for her child when they are away from the ordinary conveniences of home. For instance, she must often carry blankets, or other bedding, so that the child may comfortably nap. As with camping and picnicking activities, the blanket or bedding is necessarily a further separate article which must be transported with the other paraphernalia associated with the child's care thereby presenting added space and transportation burdens.

SUMMARY OF THE INVENTION

A multi-purpose utility tote is set forth and described herein which may be quickly and easily converted into a form suitable for different utilitarian purposes. For example, it may be used as a tote container when closed and as a substantially flat, cushioned surface when fully opened. By functioning in a multi-purpose capacity, the device assists in optimizing the space and transportation problems associated with activities such as picnicking and camping or, alternatively, child care.

The apparatus is basically comprised of two rectangular sections which are joined to form a flat, T-shaped unit having side flaps extendable transversely to form a substantially rectangular configuration. A zipper chain is provided along the entire periphery of the T-shaped unit, the single slide fastener having its starting point at an internal corner of the T-shaped unit.

The user may transform the apparatus from its substantially flat, T-shape to a three-dimensional, cubic container merely by pulling the fastener along the outer periphery of the T-shaped unit from one internal corner of the T-shaped unit to the next internal corner. To transform the apparatus back to its substantially flat shape, the user need only move the fastener back to its original position. Thus, the transformation or conversion of the apparatus between its different forms can take place using one fluid, convenient motion.

Side flaps are attached to the T-shaped unit and are extendable outward from the unit thereby providing a substantially flat, rectangular surface when the apparatus is fully opened. These side flaps are attached to the T-shaped unit so that they may be folded inward when the apparatus is to be transformed from its substantially flat form to its cubic form. The flaps are attached in such a manner so as to prevent them from interfering with the movement of the slide fastener during the transformation or conversion. When the apparatus assumes its cubic form, the flaps are located in the internal portion of the cube and contribute to both shock padding of the contents and to insulation storage for purposes of temperature control.

Additional external storage for smaller items may also be provided. For example, a pocket may be attached to one of the exterior surfaces of the unit thereby providing an external pocket which is useful when the apparatus assumes its cubic form. In the instance where the inventive apparatus has been adapted for child care, two external pockets are employed. One such pocket has a zipper seal. The other such pocket is not sealed so as to provide the parent with easy access thereto when, as is often the case, the parent must simultaneously access the contents of the pocket while carrying the child.

A pouch is provided which may be detachably mounted at an internal surface of the unit with a Velcro ™ loop fastener secured to both the pouch and the internal surface. Making the pouch selectively detachable enhances the use of the unit in its substantially flat form since any interference which a permanently attached pouch would cause when the unit is laid flat is eliminated by detaching it from the internal surface. When used as a container, the pouch is attached within the unit to restrict its mobility. This restricted mobility gives added protection to the contents of both the unit and the pouch by limiting the frequency and energy of collisions therebetween due to mechanical shock.

A shoulder strap is provided to assist the user in transporting the unit and its contents when it is used as a container. The strap is attached to one of the external surfaces of the apparatus and may be adjustable to accommodate the varying sizes of the individuals who may use the unit.

Further features may be added to the unit to specifically adapt it for child care. For example, a rectangular piece of material connected to and extending between the outer edges of the side flaps may be used to form a pocket which can accommodate a child. A zipper may be placed along one edge of the connection between one of the side flaps and the rectangular piece of material to facilitate placement of the child into the pocket when the zipper is fully opened and to secure the child therein when the zipper is fully closed.

Since a mother is often called upon to transport a diverse range of child care paraphernalia, additional pockets at the interior surface of the tote are employed. At least one such pocket has a waterproof nylon construction adapted to accommodate soiled diapers or, alternatively, food containers which could possibly break.

Opposing straps, connectable to one another by a Velcro ™ fastener, are attached to an interior face of the unit to secure bulk items such as, for example, fresh diapers. Employment of the straps enhances the overall efficient use of the available space within the unit interior without depleting the availability of pocket space.

In instances where the apparatus has been adapted for child care, two external pockets are employed. One such pocket has a zipper seal while the other such pocket is not sealed at all. The unsealed pocket provides the parent with easy access thereto when, as is often the case, the parent must simultaneously access the contents of the pocket while carrying the child.

BRIEF DESCRIPTION OF THE DRAWINGS

Other objects, features, and advantages of the invention, will be best understood from the following detailed description, taken in conjunction with the accompanying drawings, on which:

FIG. 1 is a perspective view of the invention in its fully closed cubic container form.

FIG. 2 is a cross-sectional view of the apparatus taken on line II—II of FIG. 1.

FIG. 3 is a plan view of the external surfaces of the apparatus as they appear when the apparatus is fully opened to its substantially flat form.

FIG. 4 is a plan view of the internal surfaces of the apparatus as they appear when the apparatus is opened to its substantially flat form having one set of the flaps folded inward.

FIG. 9 is a perspective view of the invention in its fully opened form as the apparatus is adapted for child care uses.

FIG. 10 is a cross-sectional view of the apparatus taken on line X—X of FIG. 9.

FIG. 11 is a cross-sectional view of the apparatus taken on line XI—XI of FIG. 9.

FIG. 12 is a cross-sectional view of the apparatus taken on line XII—XII of FIG. 9 wherein one of the side flaps is folded over.

FIG. 13 is a perspective view of the apparatus in its fully developed container form as it is adapted for child care uses.

FIG. 14 is a cross-sectional view showing the layered construction of the panels comprising the T-shaped unit.

DESCRIPTION OF THE PREFERRED EMBODIMENT

Figure 5:
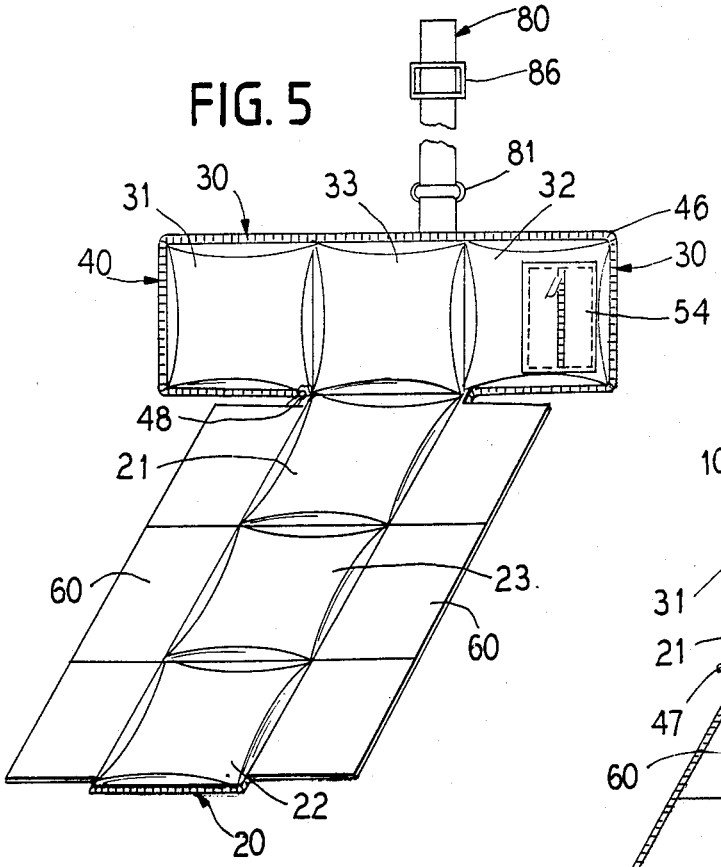
FIGS. 5–8 are perspective successive serial views of the apparatus as it is transformed or converted from its substantially flat developed form to its cubic container form.
Figure 6:
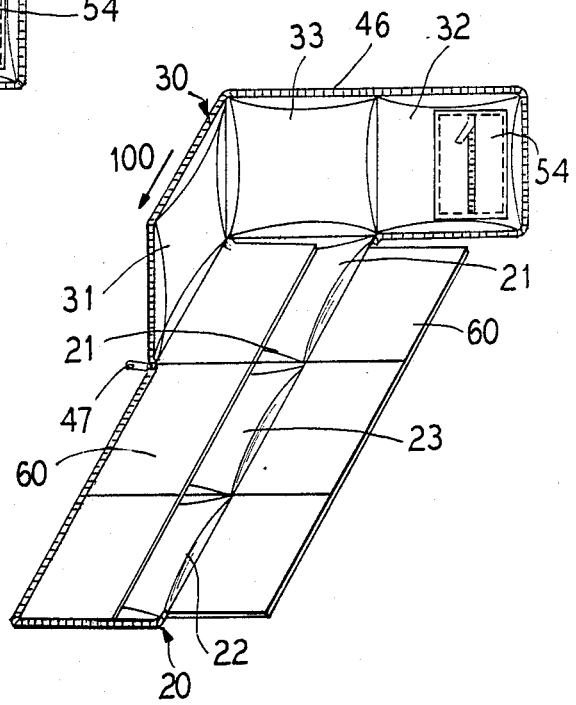

FIG. 1 shows one preferred embodiment of the invention as it appears when fully closed in its cubic container form. This same preferred embodiment, as it appears when fully opened to its substantially flat form, is shown in both of FIGS. 3 and 4. As can be seen from these figures, the unit is comprised of a first rectangular section 20 and a second rectangular section 30 of approximately equal size joined to form a flat, T-shaped unit shown generally at 40.

As shown in the cross-section of FIGS. 2 and 14, each rectangular section 20, 30 comprises a plurality of layers. The interior lining 41 of the T-shaped unit 40 is comprised of a soft material, such as cotton, which is not abrasive to the skin while the exterior covering 42 is formed of nylon, or an equivalent lightweight, water-resistant material. Immediately adjacent the interior surface of the exterior covering 42 is a layer of foam rubber 43. An amount of quilting material or batting 44 is disposed between the foam rubber 43 and the interior lining 41. This batting or quilting material 44 acts as a cushion between the interior lining 41 and exterior covering 42 and, in conjunction with the foam rubber 43, provides thermal insulation as well as shock absorption functions. Further insulation may be provided by employment of a material such as Thermal R ™ for the interior lining 41. Such material is an ultra-thin insulating interlining which is engineered for thermal efficiency.

It should also be noted that the interior lining 41 may be comprised of a nylon or vinyl material while the exterior lining may be comprised of a durable cloth. Such a structure prevents any spills which may occur when the unit 40 is used for picnicking in its substantially flat form from penetrating the interior layers of the unit 40.

Each rectangular section 20, 30 is divided into three square panels: a first end panel 21, 31, a second end panel 22, 32, and a middle panel 23, 33. The edges of each square panel are defined by stitching, for example, as shown at 50, which fastens the interior lining 41, the batting 44, the foam rubber 43, and the exterior covering 42 together.

The first end panel 21 of the first rectangular section 20 is attached to the middle panel 33 of the second rectangular section 30 along edge 51 to form the T-shaped unit 40. Given the manner of such attachment, it follows that the length of each of the rectangular sections 20, 30 is roughly three times (3×) its width if a cubic form is desired. However, it will be recognized by those skilled in the art that other proportions are possible if the shape of the apparatus is to take on the form of a rectangle or other parallelepiped.

A zipper chain 46 extends along the entire outer peripheral edge of the T-shaped unit 40. A slide fastener 47 is located at an interior corner 48 of the T-shaped unit 40 when the apparatus is fully opened in its substantially flat form. So as to allow continuous movement of the slide fastener 47 along the zipper chain 46, the zipper chain 46 is executed along the peripheral edge as a single piece without any disjunctions which would otherwise impede the motion of the slide fastener 47.

During manufacturing, the zipper chain 46 is first attached, via stitching, at the interior corner 48 of the T-shaped unit. The chain 46 is then attached, via stitching, along the entire periphery of the T-shaped unit 40 until it is once again terminated at the interior corner 48. An excess length of the zipper chain 46 should be made available at the interior corner 48 for threading the slide fastener 47 thereon. Once the slide fastener 47 has been so threaded, the excess zipper chain 46 is stitched to secure the slide fastener 47 on the chain 46.

Side flaps 60, 60 are provided to increase the available surface area of the apparatus in its substantially flat form. The side flaps 60, 60 are attached along each side of the length of the first rectangular section 20 and are extendable transversely when the apparatus assumes its flat form. So as not to interfere with the interaction of the slide fastener 47 with the zipper chain 46, the side flaps 60, 60 are attached at the interior lining 41 of the first rectangular section 20.

The side flaps 60, 60 also have a layered construction (see FIG. 12) comprising an amount of cotton batting 61 disposed between two sheets of lining material 62, 62. The layers of each side flap 60 are stitched together to effectively form three panels, each panel corresponding to a respective panel of the first rectangular section 20.

When the zipper chain 46 and the slide fastener 47 are to interact in converting the apparatus into its cubic form, the side flaps 60, 60 are folded over onto the interior lining of the first rectangular section 20. With the apparatus in its cubic form, the flaps 60, 60 are located in the hollow internal portion 71 of the cube and contribute to both shock padding of the contents and to insulation storage for purposes of temperature control.

There are a series of intermediate stages which the apparatus undergoes in its transformation or conversion from the substantially flat form shown in FIGS. 3 and 4 to the cubic container form shown in FIGS. 1 and 2. These intermediate stages are shown in FIGS. 5–8.

To begin the conversion or transformation, the first rectangular section 20 is positioned to be approximately perpendicular to the second rectangular section 30. The first end panel 31 of the second rectangular section 30 is then aligned with the first end panel 21 of the first rectangular section 20 to facilitate movement of the slide fastener 47. The slide fastener 47 is moved in the direction denoted by arrow 100 from the position shown in FIG. 5 to the position shown in FIG. 6 thereby joining the edges of the first end panels 21, 31 of the first and second rectangular sections 20, 30.

Figure 7:
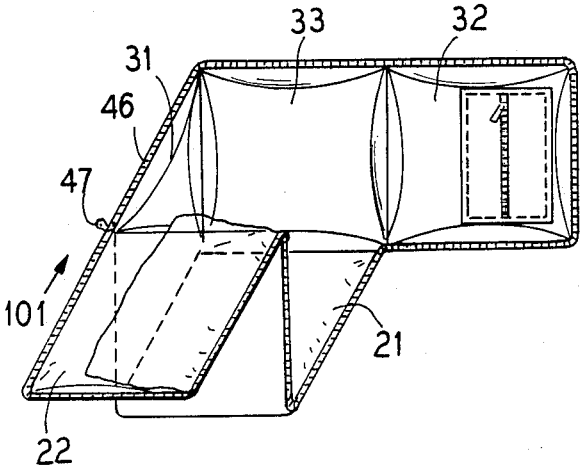

The process is similarly repeated to join the middle panel 23 of the first rectangular section 20 with the first end panel 31 of the second rectangular section 30 by moving the slide fastener 47 in the direction denoted by arrow 101 shown in FIG. 7.

Figure 8:
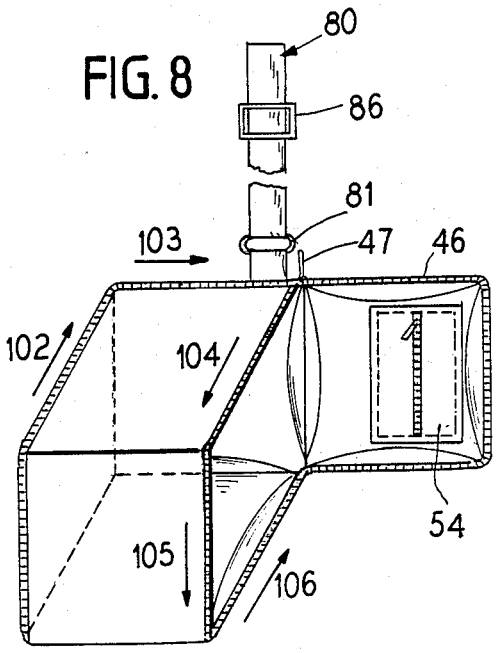

The slide fastener is continuously activated in the directions shown by arrows 102, 103, 104, 105 and 106 to join the first and second rectangular sections 20, 30 through the intermediate stage shown in FIG. 8 until all of the edges are finally engaged as shown in FIG. 1 to form the cube body 70 having a substantially open region 71 disposed therein.

As shown in FIG. 1, the zipper chain 46 defines at least one edge of each side panel of the cube body 70 and may define as many as three edges of some side panels, as will be apparent from comparing FIGS. 1–8.

Attached to the exterior covering 42 of the cube body 70 are an external pocket 73 and an adjustable shoulder strap 80. The pocket is constructed from a flat piece of material which is stitched on three sides to the exterior covering 42 of the second end panel 32 of the second rectangular section 30 thereby to provide additional storage space for carrying smaller items.

The strap 80 provides the user with a means for carrying the cube body 70 and is preferably adjustable. The strap 80 is securely fastened to the middle panel 33 and comprises a first portion 81 stitched as at 82 to the edge of the panel 33 and having a closed metal loop 83 permanently connected thereto, for example, by doubling the first portion 81 back upon itself after first threading it through the loop.

The second portion of the strap is shown at 84 and includes a first end securely fastened to the opposite edge of the middle panel as at 85. The second portion 84 passes through the parallel legs of a buckle 86 and is then threaded through the loop and a return leg is permanently connected to the cross piece 87 of the buckle. By sliding the buckle 86 along the length of the strap 80, the total effective length of the strap 80 can be adjusted by shortening the length of the return leg. The adjustability of the strap compensates for the differences in individual user sizes. A secpmd strap (not shown) may be attached opposite the strap 80 to facilitate upright carrying of the tote.

A nylon pouch 54 is detachably mounted to the interior lining 41 of the second end panel 32 by using a Velcro ™ fastener 55 having its components affixed to both the interior lining 41 and the pouch 54. Use of such a pouch enhances the function of the apparatus when employed as a tote since the pouch 54 may be used to store various smaller items which might not otherwise be appropriately stored in the substantially open region 71 of the interior of the cube body 70.

Making the pouch 54 selectively detachable enhances the use of the apparatus in its substantially flat form since any interference which a permanently attached pouch would cause when the apparatus is laid flat is eliminated by detaching the pouch 54 from the internal lining 41. When used as a tote in the form of the cube body 70, the pouch 54 is attached to the internal lining 41 of the apparatus to restrict its mobility. This restricted mobility gives added protection to the items within the substantially open region 71 and within the pouch 54 by limiting the frequency and energy of collisions therebetween due to mechanical shock.

An internal pocket (not shown) may be placed at an interior face of one of the panels. Stitching is used to divide the pocket into several sub-compartments which are adapted to accept, for example, plastic eating utensils. Additionally, a further pocket (not shown) may be employed which is adapted to store, for example, paper plates. Construction of such pockets can proceed in accordance with the pockets of the further embodiment discussed below.

FIGS. 9–13 illustrate a further embodiment of the present invention which is adapted for use by a parent in the care of his/her child when away from home.

One of the dominant features of the further embodiment is the inclusion of a rectangular piece of material 110, preferably the same soft material as used for the lining 141, which is attached to the outer joining edges 111, 111 of the side flaps as at 160, 160 and, further, along the bottom edge of the side flaps 160, 160 and first rectangular section 120. This rectangular piece of material 110, in conjunction with the side flaps 160, 160 and the first rectangular section 120, forms a pocket which is adapted to accommodate an infant.

A zipper chain 112 and slide fastener 113 are attached along a joining edge 111 of the rectangular piece of material 110 and side flap 160, the chain 112 extending only partially along the the length of the joining edge 111. When the slide fastener 113 is positioned to place the zipper chain 112 in its open condition, the size of the pocket opening is increased thereby facilitating the insertion and extraction of the child to and from the pocket. Once the child is in the pocket, the slide fastener 113 may be used to join the zipper chain 112 thereby securing the child in the pocket.

Each interior surface of the first end panel 131, second end panel 132 and middle panel 133 of the second rectangular section 130 includes a respective pocket 190, 191, 192. As exemplified in FIG. 10, the pockets 190 and 192 are each formed by adding a rectangular piece of material 193 (preferably, interior lining material) which is stitched on at least three sides thereof to the interior lining 141. The open side of the pockets 190, 192 may be selectively fastened by using a Velcro ™ fastener 194 having its components attached to both the rectangular piece of material 193 and interior lining 141.

A waterproof pocket 191 is formed by stitching a rectangular patch of nylon material 195 along three edges of the middle panel 133 of the second rectangular section 130. A nylon cover flap 196 is stitched along the edge of the middle panel 133 proximate the pocket opening and is folded over the pocket opening to engage the outer surface of the waterproof pocket 191 at a Velcro ™ fastener. This waterproof pocket 191 can accommodate food containers which could possibly break. Alternatively, the waterproof pocket 191 may be used to temporarily store soiled diapers.

A pair of straps 200, 200 are secured to the interior lining 141 at the edges of the first end panel 131 of the second rectangular section 130. Each strap 200, 200 is comprised of two strips 201, 202 joined to opposite parallel edges of the first end panel 131 and extending toward the middle thereof to connect to one another at a Velcro ™ fastener 203. These straps 200, 200 may be used to secure bulk items such as, for example, fresh diapers, without depleting the available pocket space.

A pouch 154 is also employed in this further embodiment of the invention. This pouch 154 is especially adapted to holding food containers, such as baby bottles, in that it is longer than the pouch employed in the previously described embodiment. The pouch 154 has a layered construction (not shown) with an exterior covering of nylon, an interior lining of plastic, and a foam rubber insulation layer therebetween.

The exterior of the mouth of the pouch is defined by a heavy gauge woven acrylic lip 204. The interior of the mouth (not shown) is defined by two opposing strips forming a Velcro ™ *fastener capable of sealing the entire periphery of the mouth opening.*

Two external pockets 210, 211 are employed in this further embodiment and are shown in FIG. 13. One such pocket shown at 210 has a zipper seal 212 while the other such pocket shown at 211 is not sealed at all. The unsealed pocket 211 provides the parent with easy access thereto when, for example, the parent must simultaneously access the contents of the pocket while carrying the child.

Although other modifications and changes may be suggested by those skilled in the art, it is the intention of the inventor to embody within the patent warranted hereon any changes and modifications as reasonably and properly come within the scope of this contribution to the art.

I claim:

1. A multi-purpose utility tote comprising:

a T-shaped unit having a perimeter;

a zipper chain extending about said perimeter of said T-shaped unit, said zipper chain having a starting point at an internal corner of said T-shaped unit and extending continuously about said perimeter of said T-shaped unit to ultimately terminate at said internal corner; p1 a slide fastener having a starting point at said internal corner of said T-shaped unit, said T-shaped unit being convertible into a parallelepiped container by pulling said slide fastener from said starting point at said internal corner of said T-shaped unit to an end point at a further internal corner of said T-shaped unit, pulling of said slide fastener causing engagement of said zipper chain thereby folding said T-shaped unit to form side panels of said parallelepiped container.

2. A multi-purpose utility tote as recited in claim 1, further comprising side flaps connected to said T-shaped unit and extendable laterally, said side flaps connected at an interior surface of said T-shaped unit and foldable inward toward said T-shaped unit to prevent said side flaps from interefering with any operation of said slide fastener when converting said T-shaped unit into said parallelepiped container.

3. A multi-purpose utility tote as recited in claim 2, further comprising a further flap extending between exterior edges of said side flaps and connected to said exterior edges to form a pocket defined by said further flap, said side flaps, and a portion of said T-shaped unit.

4. A multi-purpose utility tote as recited in claim 1, further comprising at least one exterior pocket connected to said T-shaped unit.

5. A multi-purpose utility tote as recited in claim 1, further comprising a pouch detachably mounted to an interior surface of said T-shaped unit.

6. A multi-purpose utility tote as recited in claim 5, wherein a Velcro ™ fastener is disposed between said pouch and said T-shaped unit for detachably mounting said pouch to said T-shaped unit.

7. A multi-purpose utility tote as recited in claim 1, further comprising a strap connected at an exterior portion of said T-shaped unit, said strap providing means for carrying said tote when said tote is fully converted to said parallelipiped container.

8. A multi-purpose utility tote as recited in claim 7, wherein said strap is provided with means for adjusting the length thereof.

9. A multi-purpose utility tote as recited in claim 1, wherein said parallelipiped container is a cubic container.

10. A multi-purpose utility tote comprising:

a T-shaped unit having a perimeter, said substantially flat T-shaped unit having first and second rectangular sections, each of said first and second rectangular sections having a first end panel, a second end panel, and a middle panel, each of said first and second end panels and said middle panels being of substantially equal size, said first panel of said first rectangular section being connected to said middle panel of said second rectangular section to form said T-shaped unit;

a zipper chain extending about said perimeter of said T-shaped unit, said zipper chain having a starting point at an internal corner of said T-shaped unit and extending continuously about said perimeter of said T-shaped unit to ultimately terminate at said internal corner;

a slide fastener having a starting point at said internal corner of said T-shaped unit;

said T-shaped unit being convertible into a cubic container by pulling said slide fastener from said starting point at said internal corner of said T-shaped unit to an end point at a further internal corner of said T-shaped unit, pulling of said slide fastener causing engagement of said zipper chain thereby folding said T-shaped unit to form side panels of said cubic container.

11. A multi-purpose utility tote as recited in claim 10, wherein said T-shaped unit comprises: an internal lining formed from a non-abrasive material; and, an exterior covering formed from a water-resistant material.

12. A multi-purpose utility tote as recited in claim 11, wherein said T-shaped unit further comprises batting disposed between said internal lining and said exterior covering.

13. A multi-purpose utility tote as recited in claim 10, wherein said T-shaped unit further comrpises a layer of foam rubber disposed between said batting and said exterior covering.

14. A multi-purpose utility tote as recited in claim 13, further comprising stitching for connecting said internal lining, said exterior lining, and said batting to each other in a layered configuration, said stitching defining edges of said first and second end panels and said middle panel of said first and second rectangular sections.

15. A multi-purpose utility tote as recited in claim 10, further comprising side flaps connected to said first rectangular section of said T-shaped unit and extendable laterally to form a flat rectangular shape, said side flaps connected at an interior surface of said T-shaped unit and foldable inward toward said T-shaped unit to prevent said side flaps from interefering with any operation of said slide fastener when converting said T-shaped unit into said cubic container.

16. A multi-purpose utility tote as recited in claim 15, further comprising a further flap extending between exterior edges of said side flaps and connected to said exterior edges to form a pocket defined by said further flap, said side flaps, and said first rectangular section of said T-shaped unit.

17. A multi-purpose utility tote as recited in claim 10, further comprising at least one external pocket connected to said T-shaped unit.

18. A multi-purpose utility tote as recited in claim 10, further comprising a at least one internal pocket connected to said T-shaped unit.

19. A multi-purpose utility tote comprising:

a T-shaped unit having a perimeter and further having an internal lining, an external covering and insulating material, said insulating material disposed between said internal lining and said external covering, said T-shaped unit formed from first and second rectangular sections;

stitching proceeding through said internal lining, said external covering and said insulating material said stitching dividing each of said first and second rectangular sections into a first end panel, a second end panel, and a middle panel, said first end panel of said first rectangular section being connected to said middle panel of said second rectangular section thereby to form said T-shaped unit;

a zipper chain extending continuously about said perimeter of said T-shaped unit;

a slide fastener having a starting point at an internal corner of said T-shaped unit, said slide fastener providing means for converting said T-shaped unit into a cubic container, said T-shaped unit being folded as a result of operation of said slide fastener whereby said first and second end panels and said middle panel of each of said first and second rectangular sections to form sides of said cubic container.

20. A multi-purpose utility tote as recited in claim 19, further comprising side flaps connected to said first rectangular section of said T-shaped unit and extendable laterally to form a flat rectangular shape, said side flaps connected at an interior surface of said T-shaped unit and foldable inward toward said T-shaped unit to prevent said side flaps from interefering with any operation of said slide fastener when converting said T-shaped unit into said cubic container.

21. A multi-purpose utility tote as recited in claim 20, further comprising a further flap extending between exterior edges of said side flaps and connected to said exterior edges to form a pocket defined by said further flap, said side flaps, and said first rectangular section of said T-shaped unit.

* * * * *